US005295428A

United States Patent [19]

Heitmann et al.

[11] Patent Number: 5,295,428

[45] Date of Patent: Mar. 22, 1994

[54] METHOD OF DISASSEMBLING LARGE-CALIBER COMBAT CARTRIDGES AND USE OF THE CARTRIDGE COMPONENTS OBTAINED BY THE METHOD FOR THE PRODUCTION OF NEW CARTRIDGES

[75] Inventors: Thomas Heitmann; Klaus Unterstein, both of Düsseldorf; Walter Simon, Herzogenrath; Dieter Jungbluth, Herschbach, all of Fed. Rep. of Germany

[73] Assignee: Rheinmetall GmbH, Ratingen, Fed. Rep. of Germany

[21] Appl. No.: 6,853

[22] Filed: Jan. 22, 1993

[30] Foreign Application Priority Data

Jan. 24, 1992 [DE] Fed. Rep. of Germany ..... 4201862

[51] Int. Cl.[5] ..... F42B 33/06

[52] U.S. Cl. ..... 86/49; 29/1.3; 86/1.1; 86/23; 102/293; 102/431; 102/439; 102/444; 102/464; 102/467

[58] Field of Search ..... 86/1.1, 23, 24, 49, 86/50; 29/1.3, 1.31, 1.32; 102/293, 430, 431, 433, 439, 444, 464–466, 700

[56] References Cited

U.S. PATENT DOCUMENTS 2,824,482 2/1958 North ..... 86/49
4,362,107 12/1982 Romer et al. ..... 102/444
4,444,115 4/1984 Romer et al. ..... 102/431
4,754,684 7/1988 Borgheresi ..... 86/49
5,133,240 7/1992 Thiesen et al. ..... 102/431

*Primary Examiner*—Harold J. Tudor
*Attorney, Agent, or Firm*—Spencer, Frank & Schneider

[57] ABSTRACT

The present invention relates to a method of disassembling large-caliber combat cartridges, particularly armor-piercing cartridges, including a combustible casing jacket that conically widens in the direction of the projectile, a casing bottom and a casing cover to which is fastened a sub-caliber projectile equipped with a propelling sabot.

To be able, on the one hand, to reduce expenditures for the disassembly of such combat cartridges and, on the other hand, to reuse a major portion of the original combat cartridges for the production of corresponding training cartridges, it is proposed to separate the casing jacket as well as the casing cover starting at their outer circumference, in regions having approximately the same, predetermined diameter D1. This diameter D1 here corresponds to the maximum diameter of the component of the new cartridge to be produced later from the disassembled components. The portion of the casing jacket and of the casing cover disposed between the regions is discarded and is replaced in the production of the new cartridge by a cylindrical casing jacket component having the diameter D1.

4 Claims, 2 Drawing Sheets

METHOD OF DISASSEMBLING LARGE-CALIBER COMBAT CARTRIDGES AND USE OF THE CARTRIDGE COMPONENTS OBTAINED BY THE METHOD FOR THE PRODUCTION OF NEW CARTRIDGES

BACKGROUND OF THE INVENTION

The present invention relates to a method of disassembling a large-caliber combat cartridge which is composed of a propelling charge casing and a sub-caliber projectile equipped with a propelling sabot. The propelling charge casing includes a combustible casing jacket, a casing bottom and a casing cover that is conically tapered toward the propelling sabot. The sub-caliber projectile is fastened to the casing cover and the casing jacket conically widens toward the casing cover so that it has its maximum diameter at the transition to the casing cover. The invention further relates to the use of the cartridge components obtained by the method according to the invention for the production of new cartridges, particularly for training purposes.

At present, many armies have the problem of having amounts of combat ammunition, particularly armor-piercing ammunition, stored in ammunition bunkers, which, however, will not be needed within the foreseeable future. Thought has therefore been given to how this ammunition can be economically converted to training ammunition. For this purpose, the combat cartridge must first be disassembled which generally requires opening the propelling charge casing at the connecting surface between the combustible casing jacket and the casing cover and removing the projectile together with the casing cover. The combat projectile is then replaced by a training projectile and a casing cover which are connected with the propelling charge casing. For this purpose, the new casing cover and the old casing jacket are connected with one another, for example, by means of glue.

Problems arise particularly in the disassembly and reuse of the disassembled components of older combat cartridges that can be fired from tank cannons. These cartridges are often equipped with a casing jacket that—for reasons of manufacturing technology—conically slightly widen toward the casing cover. It has been that, if such cartridges are stored for a longer period of time, the larger diameter and additionally created imbalance of the casing jacket at the casing cover may cause difficulties in loading. For that reason, cartridges have already been manufactured in the past that have cylindrical instead of conical casing jackets, with the diameter of the casing jacket being selected to be slightly less than the maximum diameter of corresponding cartridges that have a conical casing jacket.

In order to be able to utilize existing stocks of combat ammunition having conical casing jackets for the production of training cartridges, such cartridges have in the past been disassembled in such a way that the casing bottom as well as the projectile can be reused with a new guide mechanism. The casing jacket, however, was removed and replaced by a new cylindrical casing jacket.

The drawback of such a method is that many process steps are required for the disassembly of the old as well as the assembly of the new cartridge (removing the screws with which the casing cover is fastened to the projectile, unscrewing the casing cover, disassembling the safety ring and spring sheet at the bottom of the casing and corresponding assembly during the production of the new cartridge, disposal of the conical casing jacket and the casing cover, etc.).

SUMMARY OF THE INVENTION

It is an object of the present invention to provide a simple method for disassembling combat cartridges equipped with a conical casing jacket so that only low disassembly costs are involved, with a large portion of the original cartridge being usable for the manufacture of corresponding new cartridges, particularly training cartridges.

This is accomplished by the invention according to which the casing jacket as well as the casing cover are separated starting at their outer circumference in regions which have approximately the same predetermined diameter, and such diameter is less than the maximum diameter of the casing jacket. The component disposed between the two regions is discarded while the remaining components are reused.

The invention is based essentially on the concept of disassembling combat cartridges having a conical propelling charge casing by severing the casing jacket as well as the casing cover, starting at the outer circumference in two regions having approximately the same, predetermined diameter corresponding to the maximum diameter of the new cartridge later to be produced from the disassembled components. The portion of the casing jacket and the casing cover disposed between the two regions is discarded and is replaced in the manufacture of the new cartridge with a cylindrical casing jacket component (adapter) which has the same diameter as those of the two regions. Time-consuming disassembly of the casing jacket from the casing bottom and the later assembly of these components is thus no longer required since the component to be reused is not merely the casing bottom but the casing bottom together with a part of the casing jacket that is fastened thereto. The same also applies for the projectile which is reused together with a part of the casing cover.

DETAILED DESCRIPTION OF THE PREFERRED EMBODIMENTS

Figure 1:
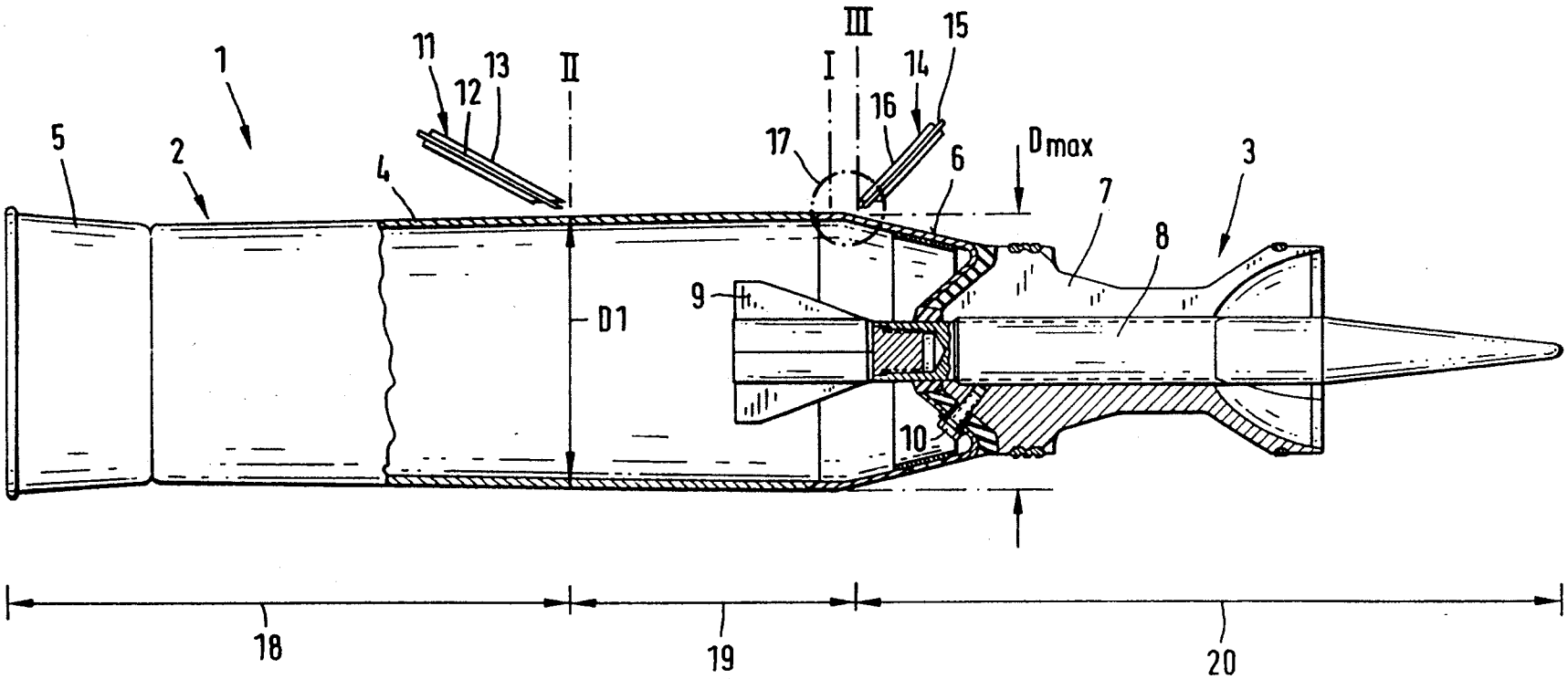
FIG. 1 is a longitudinal sectional view of a combat cartridge to be disassembled and equipped with a conical casing jacket; two separating (severing) devices are shown as well.

In FIG. 1, the reference numeral 1 identifies a large-caliber combat cartridge (e.g. 120 mm) intended for a tank cannon. Cartridge 1 is composed of a propelling charge casing 2 and a sub-caliber projectile 3. Propelling charge casing 2 is composed of a casing jacket 4, a casing bottom 5 and a casing cover 6. The sub-caliber projectile 3 is essentially composed of a propelling sabot 7 that is segmented in the longitudinal direction of the projectile and is connected in a form-locking manner by way of an unidentified threaded connection with a penetrator 8. Penetrator 8 projects into propelling charge casing 2 and is equipped at its end with a fin guide mechanism 9. In the region of the casing cover 6, propelling charge casing 2 is fastened to projectile 3 with the aid of screws 10.

Figure 2:
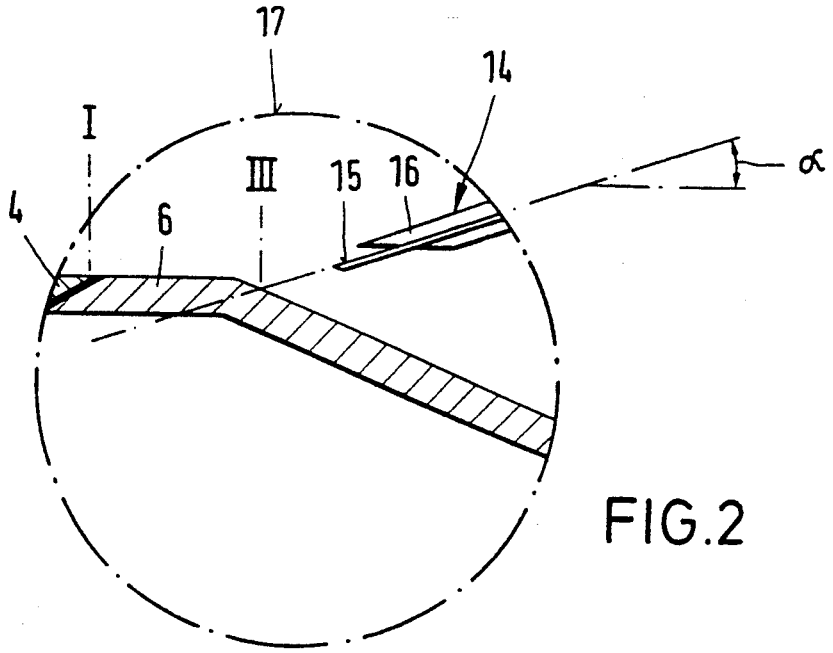
FIG. 2 is an enlarged longitudinal sectional view of FIG. 1 in the region of the casing cover where it is to be separated.

Casing jacket 4, which is composed of a combustible material, has a conical configuration and has its maximum diameter Dmax in the transition region marked I between casing jacket 4 and casing cover 6 (see also FIG. 2).

Two separating devices 11 and 14 are provided in FIG. 1 for disassembly; they are composed of a blade 12 and 15, respectively, and a holding and guiding device 13 and 16, respectively, surrounding the blade. In order to realize a comparatively large connecting surface so as to later have a stable connection, the separating devices 11 and 14 are disposed at an angle $\alpha$ of preferably less than 15° relative to casing jacket 4.

Let it be assumed hereinafter that in region I the combat cartridge shown in FIG. 1 has a maximum diameter Dmax of 156.5 mm. However, the cartridge later to be produced from the disassembled cartridge components is intended to have a maximum diameter D1 of 155.5 mm. In that case, the invention provides that separating device 11 is arranged in such a manner that casing jacket 4 is separated in the region marked II in which the diameter of propelling charge casing 2 is precisely 155.5 mm, while separating device 14 separates propelling charge casing 2 in the region III of casing cover 6 where the diameter of the propelling charge casing is likewise 155.5 mm.

After the separating processes, there then are available three cartridge components which are marked 18, 19 and 20 in FIG. 1. The first component 18 is essentially composed of the casing bottom 5 and part of the casing jacket 4 adjacent thereto. The second cartridge component 19 which is no longer required for the manufacture of future cartridges is composed of components of casing jacket 4 and casing cover 6 that are disposed between regions II and III. Finally, the third cartridge component 20 is composed of the projectile 3 and a portion of casing cover 6 that is fastened to the propelling sabot 7 of projectile 3.

To produce the training ammunition, fin guide mechanism 9 of penetrator 8 is now removed and the penetrator is exchanged. A corresponding guide mechanism 21—for example, a cone or perforated cone guide mechanism—which reduces the range of penetrator 8 is fastened to the installed penetrator (see also FIG. 3). Then, the one end of an adapter 22, which has a diameter D1 = 155.5 mm, is glued to cartridge component 18 and thereafter the other end of adapter 22 is glued to the portion of casing cover 6 that remained connected with projectile 3. The respective connecting surfaces of adapter 22 with components 18 and 20 are marked 23 and 24, respectively, in FIG. 3. The powder is introduced in a conventional manner into the finished cartridge through the bore provided in the casing bottom for the propelling charge fuze.

Figure 3:
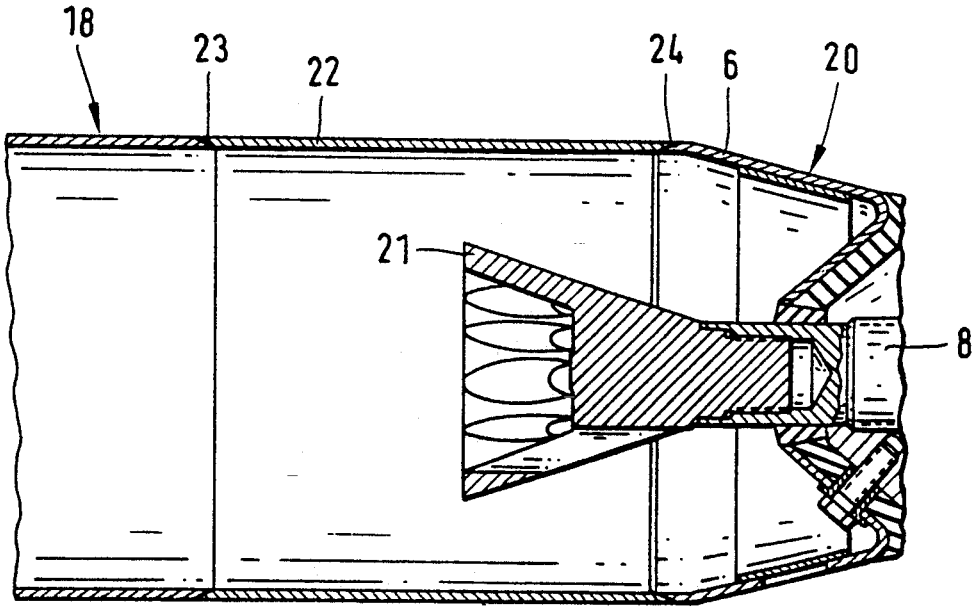
FIG. 3 is a longitudinal sectional view of part of a training projectile equipped with an adapter.

It is particularly advantageous if—as shown in FIGS. 1 to 3—the direction of the cut in casing cover 6 is opposite to the direction of flight of projectile 3 since in that case, further flanging of the imbalance in the casing cover is prevented, that is the imbalanced portion is pressed (circular) by virtue of the cutting direction.

It will be understood that the above description of the present invention is susceptible to various modifications, changes and adaptations, and the same are intended to be comprehended within the meaning and range of equivalents of the appended claims.

What is claimed is:

1. A method of dismantling a large-caliber cartridge composed of a propelling charge casing having a casing jacket, a casing bottom at one end of the casing jacket and a forwardly conically tapering casing cover at another, opposite end of the casing jacket; the casing jacket conically widening toward the casing cover, whereby the casing jacket has a maximum diameter at a location of transition to the casing cover; and a sub-caliber projectile fastened to the casing cover and composed of a penetrator and a sabot surrounding the penetrator;

the method comprising the following steps:

(a) severing the casing jacket in a first region at a casing jacket diameter that is less than said maximum diameter;

(b) severing the casing cover at a second region at a casing cover diameter that is the same as the casing jacket diameter in said first region;

(c) discarding the large-caliber cartridge part severed between the first and second regions; and (d) reusing the large caliber cartridge part extending from said first region to a rearward end of the cartridge and the large-caliber cartridge part extending from said second region to a forward end of the cartridge.

2. The method as defined in claim 1, wherein the steps of severing the casing jacket and the casing cover each comprise the step of severing at an angle of 15° to a surface of the casing jacket and the casing cover, respectively.

3. The method as defined in claim 1, wherein the step of severing the casing cover includes the step of severing the casing cover at an oblique angle to a surface of said casing cover and in a direction oriented towards the rearward end of the cartridge.

4. A method of making a training cartridge from parts of a large-caliber cartridge composed of a propelling charge casing having a casing jacket, a casing bottom at one end of the casing jacket and a forwardly conically tapering casing cover at another, opposite end of the casing jacket; the casing jacket conically widening toward the casing cover, whereby the casing jacket has a maximum diameter at a location of transition to the casing cover; and a sub-caliber projectile fastened to the casing cover and composed of a penetrator and a sabot surrounding the penetrator;

the method comprising the following steps:

(a) severing the casing jacket in a first region at a casing jacket diameter that is less than said maximum diameter;

(b) severing the casing cover at a second region at a casing cover diameter that is the same as the casing jacket diameter in said first region;

(c) discarding the large-caliber cartridge part severed between the first and second regions;

(d) reusing, in the making of the training cartridge, the large caliber cartridge part extending from said first region to a rearward end of the cartridge and the large-caliber cartridge part extending from said second region to a forward end of the cartridge; and (e) replacing, in the making of the training cartridge, the large-caliber cartridge part severed between the first and second regions, by a casing jacket part having a diameter equalling the casing jacket and the casing cover diameters at said first and second regions, respectively.

* * * * *